US007002612B2

(12) United States Patent
Imai et al.

(10) Patent No.: US 7,002,612 B2
(45) Date of Patent: Feb. 21, 2006

(54) PAPER CUTTER AND THERMAL PRINTER

(75) Inventors: Saburo Imai, Chiba (JP); Shinji Nureki, Chiba (JP)

(73) Assignee: SII P & S Inc., Chiba (JP)

( * ) Notice: Subject to any disclaimer, the term of this patent is extended or adjusted under 35 U.S.C. 154(b) by 131 days.

(21) Appl. No.: 10/367,132

(22) Filed: Feb. 14, 2003

(65) Prior Publication Data

US 2003/0174198 A1 Sep. 18, 2003

(51) Int. Cl.
*B41J 2/325* (2006.01)

(52) U.S. Cl. ..... 347/215

(58) Field of Classification Search ..... 347/215, 347/217, 218; 400/584, 593
See application file for complete search history.

(56) References Cited

U.S. PATENT DOCUMENTS 5,412,407 A * 5/1995 Okubo et al. ..... 347/215
5,917,533 A * 6/1999 Suzuki et al. ..... 347/214
6,721,060 B1 * 4/2004 Kawamura et al. ..... 358/1.3

* cited by examiner

*Primary Examiner*—K. Feggins
(74) *Attorney, Agent, or Firm*—Adams & Wilks

(57) ABSTRACT

A paper cutter has a guide for guiding continuous paper in a lengthwise direction from an inlet portion thereof to an outlet portion thereof. A cutting device disposed downstream of the guide outlet portion partially cuts the continuous paper after it passes through the guide and exits the guide outlet portion, the cutting device partially cutting the continuous paper in a widthwise direction thereof to form two separated cut portions joined at one widthwise end to an uncut portion. At least two projections protrude inwardly of the guide and contact opposite surface of the continuous paper as it passes through the guide. The projections are located in the widthwise direction of the guide so as to concentrate a tensile force applied in the lengthwise direction to the uncut portion of the partially cut continuous paper at the region where the two separate cut portions join the uncut portion to thereby facilitate tearing of the uncut portion of the partially cut continuous paper.

14 Claims, 4 Drawing Sheets

PAPER CUTTER AND THERMAL PRINTER

BACKGROUND OF THE INVENTION

1. Field of the Invention

The present invention relates to a cutter for cutting continuous paper with one portion thereof uncut and a thermal printer having the above cutter.

2. Description of the Related Art

There are some cases where a paper cutter for cutting a continuous paper which has been printed, with one portion thereof uncut, is installed in, for example, an order input device and the like for printing out the menu ordered by a customer in a fast food restaurant, a family restaurant, and the like. Hereafter, this cut is referred to as a partial cut.

The partial cut is used for various purposes of preventing the full cut paper from falling down into the device inversely from the outlet, aligning several sheets of paper with the contents of orders printed there in a sequence of the orders in a state of being connected by one portion, by supplying the paper without tearing off the uncut portion according to the partial cut when receiving the orders sequentially, and the like.

Generally, the paper appearing from the outlet after a partial cut is divided into each one sheet by a user pulling the paper and tearing off the uncut portion. In case of the partial cut in which an uncut portion of the paper is left on the right side, when a user pulls the paper, holding the left side of the paper, the cut portion of the paper is opened and a force concentrates on the root at the base of the cut, thereby making it easy to tear off the uncut portion.

However, when a user pulls the paper straightly holding the side of the uncut portion of the paper, even if the width of the uncut portion is small, a force is dispersed in this portion, and therefore, in some cases, the uncut portion cannot be torn off easily even if a user pulls it strongly. At this time, there is a fear of reeling out the connected paper from the device. When the paper is reeled out, there are such a problem that the space on the top of the paper will be expanded at the next print-out and such a fear that the paper is swayed at a forwarding time.

Generally, a thermal printer for putting the paper between a printing head and a platen, for printing, is provided in a prior stage of the cutter performing the partial cut, and the paper is in a state of being held by the pressure of the printing head and the platen. Therefore, when the paper is pulled in a state of being uncut with a force stronger than this holding force, the paper will be reeled out. Recently, however, the pressure between the printing head and the platen tends to become lower, and therefore, a problem of reeling out the paper by pulling the partial cut paper becomes more and more serious.

SUMMARY OF THE INVENTION

An object of the invention is to provide a paper cutter and a thermal printer which can tear off the paper easily and prevent reeling out of the paper from the device, even when a user pulls the partial cut paper straightly by the uncut portion.

In order to achieve the above object, the invention provides a paper cutter having a guide for guiding continuous paper and cutting means for cutting the continuous paper passing through the guide with one portion thereof uncut, wherein the guide is provided with paper bending means for bending the continuous paper so as to produce an aperture around a root of two separated portions of the continuous paper when a tensile force works on the continuous paper passing through the guide.

According to this means, even when the continuous paper is pulled in such a way that a force straightly comes on the uncut portion of the continuous paper, since an aperture is produced around the root portion and the tensile force concentrates on the root portion, the uncut portion can be torn off easily. This can prevent reeling out of the paper.

More specifically, the paper bending means can be formed by at least two projections protruding in contact with the both surfaces of the continuous paper on a path for passing the two separated portions and a root-around portion in the vicinity of the root of the continuous paper, for bending the continuous paper passing through this portion.

According to the structure, since the length of the path for passing the root-around portion becomes longer than the length of the path for passing the uncut portion of the continuous paper, in the guide, when a user pulls the continuous paper straightly, the root-Around portion is drawn toward the side of the guide because its path length is longer. Therefore, a small aperture can be produced in the root portion.

More specifically, the paper bending means can be provided with a projection protruding in contact with one surface of the continuous paper on the path for passing the two separated portions and the root-around portion in the vicinity of the root of the continuous paper and a projection protruding in contact with the other surface of the continuous paper on a path for passing an uncut portion of the continuous paper, and the continuous paper can be forcedly bent within the guide according to these two projections.

According to this structure, when a user pulls the continuous paper straightly, holding the side of the uncut portion of the continuous paper, the paper is forcedly bent in such a way that the portion corresponding to the uncut portion is bent toward one surface in the lower portion (a side of the guide) than the cut portion of the continuous paper and the portion corresponding to the root-around portion is bent toward the other surface. In the upper portion than the cut portion, however, this forced bend doesn't occur, and therefore, an aperture can be produced around the root portion of the cut portion by a difference between the both.

Preferably, the projections may be formed in a shape having such an inclination that a protruding degree is small on a side of inlet of the guide and large on a side of outlet of the guide. Thus, it is possible to pass the continuous paper smoothly without any trouble when passing the continuous paper through the guide.

Further, the above paper cutter can be adopted to a thermal printer comprising a printing device for printing by putting the continuous paper between a printing head having a plurality of heating elements for dot printing and a platen and forwarding the continuous paper while rotating the platen, and the paper cutter for cutting the continuous paper sent from the printing device to the guide.

BRIEF DESCRIPTION OF THE DRAWINGS

For a better understanding of the present invention, reference is made to the following detailed description to be read in conjunction with the accompanying drawings, in which.

DETAILED DESCRIPTION OF THE PREFERRED EMBODIMENT

Hereinafter, embodiments of the present invention will be described with reference to the drawings.

Figure 1:
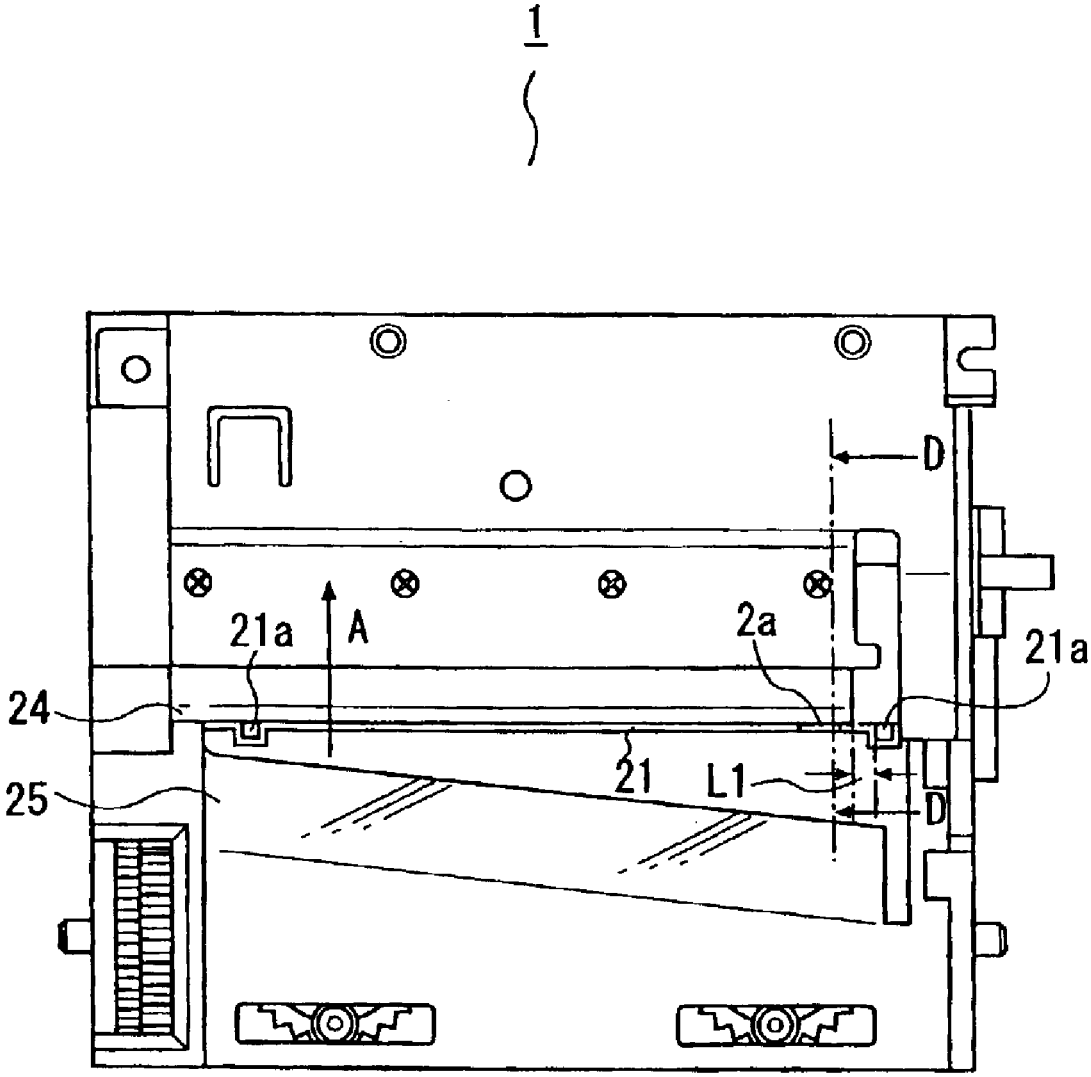
FIG. 1 is a plane view showing a thermal printer according to the embodiment of the invention.
Figure 2:
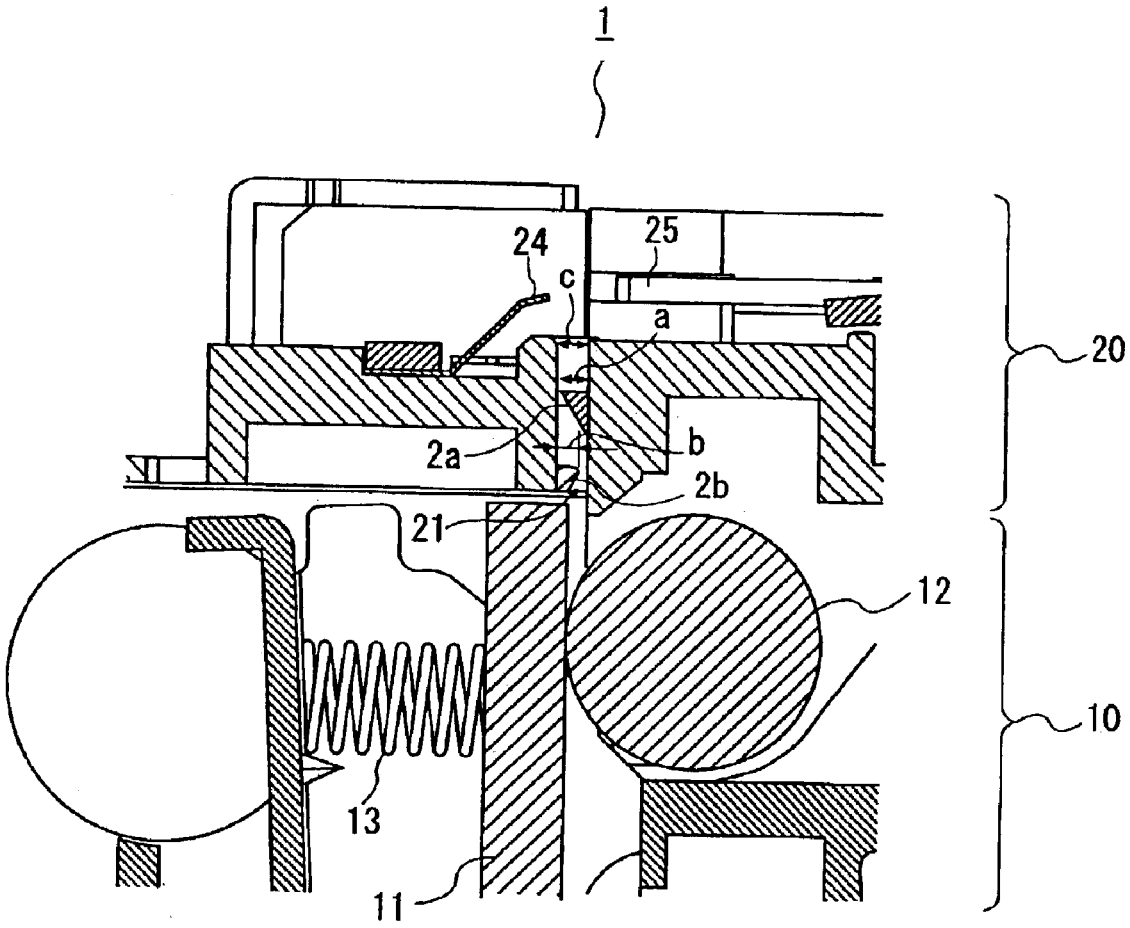
FIG. 2 is a cross section view taken along line D—D by the arrows in FIG. 1.

FIG. 1 is a plane view of a thermal printer 1 according to the embodiment of the invention and FIG. 2 is a cross section view taken along line D—D by the arrows in FIG. 1.

The thermal printer 1 of the embodiment is formed by unitizing a printing mechanism 10 for printing on continuous paper such as roll paper and a cutter 20 for partially cutting the continuous paper sent from the printing mechanism 10.

The printing mechanism 10 prints in a state of pushing the continuous paper between a printing head 11 and a platen 12, as illustrated in FIG. 2. On the printing head 11, a plurality of heating elements for dot-printing on the heat sensitive paper are provided in a line direction, so as to do the printing for one line or several lines on the paper by one or several drives. The printing head 11 is pushed toward the platen 12 by a spring 13 at a constant power. The platen 12 is formed by a member having elasticity so as to enable the paper to be brought into close contact with the portion of the heating elements of the printing head 11, and by rotating the platen 12 intermittently, the paper is advanced or forwarded lengthwise in a forwarding direction (upper portion in FIG. 2) thereby sequentially moving the printing position of the paper.

The cutter 20 comprises a guide 21 for introducing the paper discharged from a space between the printing head 11 and the platen 12, to a cutting position, and a cutting device positioned downstream of the guide 21 with respect to the forwarding direction of the paper and having a fixed blade 24 and a movable blade 25 for clipping and partially cutting the paper passing through the guide 21. The guide 21 is designed to surround both surfaces of the paper by its two walls wider than the paper and keep into contact with the both sides of the paper by its right and left convex pieces 21*a*, 21*a* so as not to sway the paper. Further, the passage length of the guide 21 is fairly short (for example, 6 to 10 mm). On the guideway of the guide 21, two projections 2*a* and 2*b* are provided as paper bending means for bending the paper so as to produce an aperture around a root of the two separated portions of the paper when the paper is pulled from the outside and a tensile force is applied in the lenathwise direction of the paper.

The movable blade 25 and the fixed blade 24 are respectively as long as the width of the paper or a little longer than that. The movable blade 25 moves back and forth in the direction indicated by the arrow A by the force of a driving motor not illustrated and pinches the paper with the fixed blade 24 so to cut the paper. During printing or while the platen 12 is rotating to forward the paper, the movable blade 25 is waiting at a position not overlapped with the outlet of the guide 21.

The fixed blade 24 is arranged not to overlap the right end portion of the paper passage and due to this arrangement, the right end portion of the paper remains as it is without being cut. Namely, the range L1 from the right end portion of the fixed blade 24 to the convex piece 21*a* on the right side of the guide 21 functions to leave the paper behind as an uncut portion so that the blades 24 and 25 partially cut the continuous paper in the widthwise direction thereof to form two separated cut portions joined to an uncut portion.

Figure 3A:
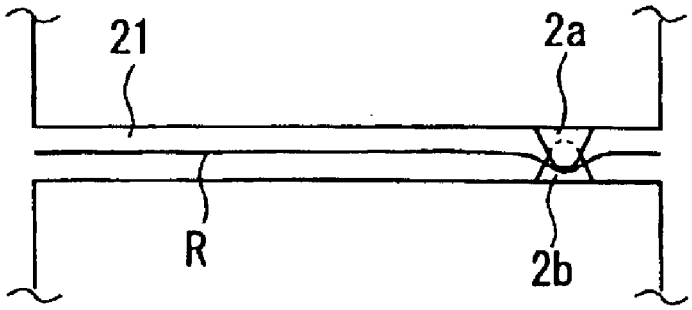
FIG. 3 shows views from three viewpoints, for use in describing the first embodiment of the projections provided in the guide and the functions thereof.
Figure 3B:
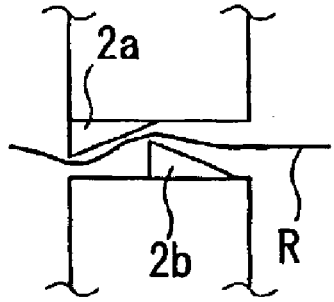
Figure 3C:
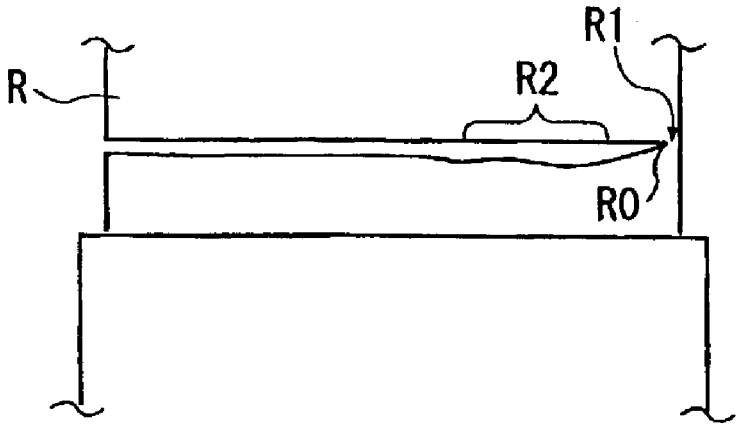

FIG. 3 shows views from three viewpoints, for use in describing the projections provided in the guide and the functions thereof. FIGS. 3(*a*) is a plane view, (*b*) is a side lateral view, and (*c*) is a front view.

The projections or protruding portions 2*a* and 2*b* according to this embodiment are provided in the guide 21 upstream of the cutting device 24, 25 in the portion where the paper R is separated into two separated cut portions and in the range where the root-around portion R2 in the vicinity of the root R0 passes. Further, the projections 2*a* and 2*b* are provided at different positions in height; one projection 2*a* is provided on one surface of the guide 21 and the other projection 2*b* is provided on the other surface of the guide 21 opposite the one surface. These projections 2*a* and 2*b* are designed to have an inclination such that a protruding degree can be small on the side of the inlet of the guide 21 and large on the side of the outlet thereof (inclined about 30° to the wall surface of the guide 21) and that the sum of the maximum protruding degrees a and b of the two projections can be larger than the interstice c of the guide 21 (a+b>c).

According to the guide 21 having these projections 2*a* and 2*b*, when a user pulls the paper R straightly, holding the right end portion of the paper R, the paper becomes stretched tightly because there is no projection in the range of passing the uncut portion R1 of the paper R in the guide 21. While, in the range of passing the root-around portion R2 of the paper R, since there are the projections 2*a* and 2*b*, the paper R is bent in a shape of S (FIG. 3(*b*)) from a lateral view and the passage of the paper becomes longer compared with the case of the straight line.

Accordingly, the paper is a little drawn downwardly under the root-around portion R2, thereby producing an aperture in the portion around the root R0 of the paper. A tensile force concentrates on this portion around the root R0 and the uncut portion R1 becomes easy to tear.

Next, various modifications of the projection for bending the paper R so as to produce an aperture around the root R0 of the paper R as mentioned above will be described.

Figure 4A:
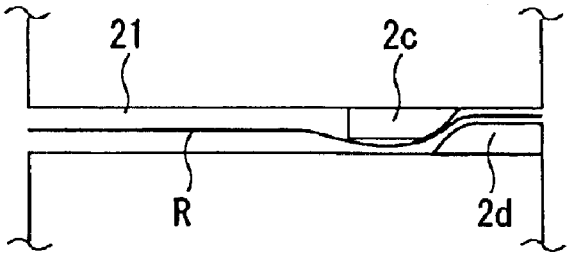
FIG. 4 shows views from three viewpoints, for use in describing the second embodiment of the projections provided in the guide and the functions thereof.
Figure 4B:
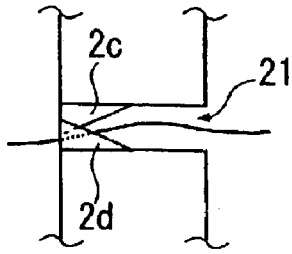
Figure 4C:
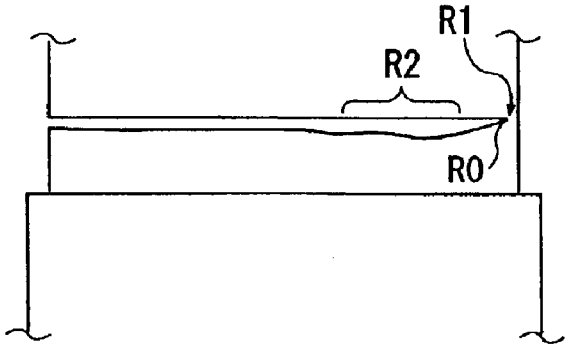

FIG. 4 shows views from three viewpoints, for use in describing a second embodiment of these projections and the functions thereof. FIGS. 4(*a*) is a plane view, (*b*) is a side lateral view, and (*c*) is a front view.

In the case of projections or protruding portions 2*c* and 2*d* of the second embodiment, in the guide 21, one projection 2*c* is provided in the range of passing the root-around portion R2 of the paper R and the other projection 2*d* is provided in the range of passing the uncut portion R1 of the paper R. As illustrated in FIG. 4(*b*), the two projections are arranged at the same position in height on the outermost outlet side in the guide 21. Alternatively, they both may be arranged at different positions in height.

The projections 2*c* and 2*d* have an inclined shape similarly to the projections 2*a* and 2*b* of FIG. 3 and they are designed such that the sum of the maximum protruding degrees of the two projections 2*c* arid 2*d* may become larger than the interstice between the both walls of the guide 21.

According to the guide 21 having these projections 2*c* and 2*d*, when a user pulls the paper R straightly, holding the right end portion of the paper R, the paper R is forcedly bent in a shape of S from the top view, in the lower portion than the cut portion of the paper R, as illustrated in FIG. 4(*a*). Namely, the portion corresponding to the uncut portion R1 is bent toward one wall of the guide 21 and the portion corresponding to the root-around portion R2 is bent toward the other wall of the guide 21. While, in the upper portion than the cut portion of the paper R, the paper R is never bent forcedly but stretched straightly by pull of the paper R. Accordingly, since the position of the root-around portion R2 is deviated back and forth in the portion upper than the cut portion and the portion lower than that, the portion around the root R0 of the paper R is in an open state, and a tensile force concentrates on this portion around the root R0, thereby making it easy to tear the uncut portion R1.

Figure 5A:
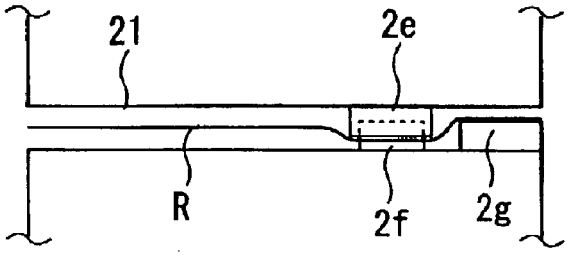
FIG. 5 shows views from three viewpoints, for use in describing the third embodiment of the projections provided in the guide and the functions thereof.
Figure 5B:
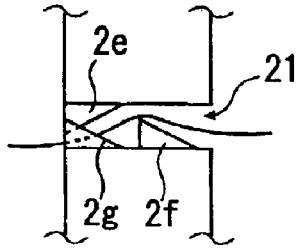
Figure 5C:
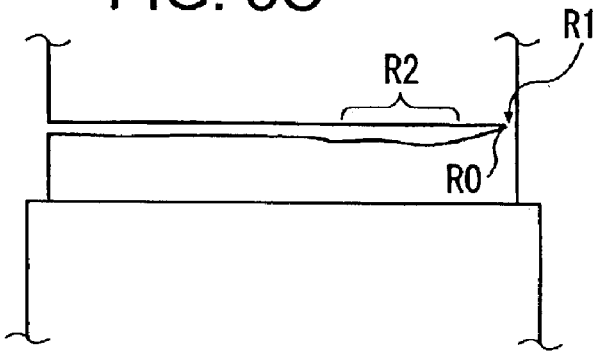

FIG. 5 shows views from three viewpoints, for use in describing a third embodiment of the projections provided in the guide and the functions thereof. FIGS. 5(*a*) is a plane view, (*b*) is a side lateral view, and (*c*) is a front view.

The third embodiment uses three projections or protruding portions which are a combination of the projections 2*a* and 2*b* of the first embodiment in FIG. 3 and the projections 2*c* and 2*d* of the second embodiment in FIG. 4. Namely, two projections 2*e* and 2*f* have the same effect as the projections 2*a* and 2*b* of the first embodiment and two projections 2*e* and 2*g* have the same effect as the projections 2*c* and 2*d* of the second embodiment.

Namely, according to the guide 21 having these projections 2*e*, 2*f*, and 2*g*, when a user pulls the paper R straightly, holding the right end of the paper R, the lower portion of the root-around portion R2 is drawn downwardly and pushed forward, thereby producing an aperture in the portion around the root R0. A tensile force concentrates on the portion around the root R0, thereby making it easy to tear the uncut portion R1.

As mentioned above, according to the cutter 20 and the thermal printer 1 of the embodiments, the projections provided in the guide 21 bend the paper R so as to produce an aperture in the root R0 of the two separated portions of the paper R when the paper R is pulled straightly, and a force concentrates on the portion around the root R0, which makes it easy to tear the uncut portion R1 of the paper R. Therefore, it is possible to restrain the occurrence of such a disadvantage as reeling out the paper R from the device.

By using the projections 2*a* to 2*g* on the guide 21 as the means for bending the paper R, the structure of making it easy to tear the uncut portion R1 of the paper R can be realized at a low cost. Further, since the projections 2*a* to 2*g* are formed in an inclined shape, it is possible to pass the paper R smoothly along the guide 21.

The invention is not restricted to the above embodiments, but various modifications are possible. For example, as the paper bending means for bending the paper, the wall surface of the guide may be formed in a curved shape so as to get the same passage of the paper as in the case of providing the guide with the projections. Further, the shape or the number of the projections for bending the paper is not restricted to the above-mentioned concrete examples, but various modifications are possible.

Although the description has been made by, for example, the paper cutter of the type of cutting the paper by pinching it between the fixed blade and the movable blade moving back and forth in the embodiments, the invention can be adopted to a cutter of any type including a rotary cutter for cutting the paper while moving a rotary blade along the width direction of the paper and the like.

As set forth hereinabove, according to the invention, when a user pulls the paper and a tensile force works on the paper, owing to the paper bending means, since the paper is bent so as to produce an aperture around the root of the two separated portions of the paper, it is effective in tearing the uncut portion of the paper easily.

Since the paper bending means is formed by providing the guide with the projections, it is effective in realizing the structure of making it easy to tear the uncut portion of the paper, at a low cost.

What is claimed is:

1. A paper cutter comprising:

a guide for guiding continuous paper;

cutting means for partially cutting the continuous paper passing through the guide to form two separated cut portions joined to an uncut portion; and paper bending means disposed in the guide upstream of the cutting means for bending the continuous paper so as to produce an aperture around a root of the two separated cut portions of the partially cut continuous paper when a tensile force is exerted on the continuous paper passing through the guide.

2. A paper cutter according to claim 1; wherein the paper bending means comprises a projection protruding in contact with one surface of the continuous paper on the path for passing the two separated cut portions and the root-around portion in the vicinity of the root of the continuous paper, and a projection protruding in contact with the other surface of the continuous paper on a path for passing the uncut portion of the continuous paper, whereby the continuous paper is forcedly bent within the guide by the two projections.

3. A paper cutter according to wherein the paper bending means comprises at least two projections protruding in contact with opposite surfaces of the continuous paper on a path for passing the two separated cut portions and a root-around portion in the vicinity of the root of the continuous paper, for bending the continuous paper passing through the guide.

4. A paper cutter according to claim 3; wherein the projections are formed in a shape having such an inclination that a protruding degree thereof is smaller on a side of an inlet of the guide and larger on a side of an outlet of the guide.

5. A thermal printer comprising:

a paper cutter according to claim 4; and a printing device for printing on the the continuous paper by forwarding the continuous parer between a printing head having a plurality of heating elements for dot printing and a platen and thereafter forwarding the printed continuous paper to the guide of the paper cutter so as to be cut.

6. A thermal printer comprising:

a paper cutter according to claim 2; and a printing device for printing on the the continuous paper by forwarding the continuous paper between a printing head having a plurality of heating elements for dot printing and a platen and thereafter forwarding the printed continuous paper to the guide of the paper cutter so as to be cut.

7. A thermal printer comprising:

a paper cutter according to claim 3; and a printing device for printing on the the continuous paper by forwarding the continuous paper between a printing head having a plurality of heating elements for dot printing and a platen and thereafter forwarding the printed continuous paper to the guide of the paper cutter so as to be cut.

8. A thermal printer comprising:

a paper cutter according to claim 1; and a printing device for printing on the the continuous paper by forwarding the continuous paper between a printing head having a plurality of heating elements for dot printing and a platen and thereafter forwarding the printed continuous paper to the guide of the paper cutter so as to be cut.

9. A paper cutter comprising: a guide for guiding continuous paper in a lengthwise direction from an inlet portion thereof to an outlet portion thereof; a cutting device disposed downstream of the guide outlet portion for partially cutting the continuous paper after passing through the guide and exiting the guide outlet portion, the cutting device partially cutting the continuous paper in a widthwise direction thereof to form two separated cut portions joined at one widthwise end to an uncut portion; and at least two protruding portions protruding inwardly of the guide for contacting opposite surfaces of the continuous paper as it passes through the guide, the protruding portions being located in the widthwise direction of the guide so as to concentrate a tensile force applied in the lengthwise direction to the uncut portion of the partially cut continuous paper at the region where the two separated cut portions join the uncut portion to thereby facilitate tearing of the uncut portion of the partially cut continuous paper.

10. A paper cutter according to claim 9; wherein the at least two protruding portions are located in the widthwise direction of the guide along a path of the continuous paper in the vicinity where the two separated cut portions join the uncut portion.

11. A paper cutter according to claim 9; wherein the at least two protruding portions include a third protruding portion located in the widthwise direction of the guide along a path of the continuous paper at which is formed the uncut portion.

12. A paper cutter according to claim 9; wherein the at least two protruding portions comprise a first protruding portion located in the widthwise direction of the guide along a path of the continuous paper at which is formed the uncut portion, and a second protruding portion located in the widthwise direction of the guide along a path of the continuous paper at which are formed the two separated cut portions.

13. A paper cutter according to claim 9; wherein the at least two protruding portions comprise two protruding portions located in the widthwise direction of the guide along a path of the continuous paper at which are formed the two separated cut portions.

14. A paper cutter according to claim 9; wherein the at least two protruding portions are inclined upwardly in a direction from the guide inlet portion to the guide outlet portion.

* * * * *